US006514107B1

(12) United States Patent
Sparrow

(10) Patent No.: US 6,514,107 B1
(45) Date of Patent: Feb. 4, 2003

(54) UNIVERSAL VALVE, HOSE AND NOZZLE ASSEMBLY FOR USE WITH A PERSONAL WATERCRAFT

(76) Inventor: Greg E. Sparrow, 11047 William Ave., Taylor, MI (US) 48180

( * ) Notice: Subject to any disclaimer, the term of this patent is extended or adjusted under 35 U.S.C. 154(b) by 0 days.

(21) Appl. No.: 09/928,527

(22) Filed: Aug. 13, 2001

(51) Int. Cl.[7] ..... B63H 11/00

(52) U.S. Cl. ..... 440/39

(58) Field of Search ..... 440/38, 39; 114/55.5

(56) References Cited

U.S. PATENT DOCUMENTS

| | | | | |
|---|---|---|---|---|
| 4,787,328 A | * 11/1988 | Inoue | 440/183 R |
| 4,832,634 A | 5/1989 | Kearns | 440/67 |
| 5,299,960 A | 4/1994 | Day et al. | 440/39 |
| 5,516,313 A | 5/1996 | Lumpkin | 440/39 |
| 5,551,898 A | 9/1996 | Matsumoto | 440/41 |
| 5,752,864 A | 5/1998 | Jones et al. | 440/41 |
| 5,846,104 A | 12/1998 | Corcoran | 440/39 |
| 6,168,481 B1 | 1/2001 | Mardikian | 440/39 |
| 6,305,995 B1 | * 10/2001 | Stauning et al. | 440/39 |

* cited by examiner

*Primary Examiner*—Ed Swinehart
(74) *Attorney, Agent, or Firm*—Gifford, Krass, Groh, Sprinkle, Anderson & Citkowski, P.C.

(57) ABSTRACT

A universally adaptable valve, hose and nozzle assembly for use with a personal watercraft. The watercraft includes an interiorly configured engine compartment operated by a throttle, a rear transom forming a portion of the watercraft's structure, a rearwardly extending tail pipe and a bilge line associated with the tail pipe. Elements of the assembly include a bilge pump valve adapted to communicate the interiorly configured engine compartment with the rearwardly extending tail pipe and via the associated bilge line. A water flow diversion member has a first end and a second end, a flexible boot adaptor engaging the first end with the extending end of the tail pipe, a second end of the diversion member extending in communicable and arcuate fashion from the first end. A plurality of tensioning members extend from the flow diversion member and are adapted for securing to the transom, the tensioning members compress the first end of the diversion member and the interconnecting boot adapter against the exhaust side of a jet pump housing while inserting through a steering nozzle (or boot) secured to the outlet of the tail pipe. A flexible length of conduit threadably engages the second end of the flow diversion member and a flow distribution member is in turn threadably engaged with the second end of the length of conduit. Upon actuating the bilge pump valve from an open position to a closed position and applying the throttle, the assembly issues a pressurized flow of water through the flow distribution member and through the outlet nipple.

9 Claims, 4 Drawing Sheets

UNIVERSAL VALVE, HOSE AND NOZZLE ASSEMBLY FOR USE WITH A PERSONAL WATERCRAFT

BACKGROUND OF THE INVENTION

1. Field of the Invention

The present invention relates generally to water ejection systems, particularly those capable of being utilized with an existing personal watercraft. More particularly, the present invention discloses an improved and universally adaptable valve, hose and nozzle assembly for use with a personal watercraft and which enables the generation of a jet stream of water, while at the same time preventing the engine compartment of the watercraft from filling with water and sinking.

2. Description of the Prior Art

The prior art is well documented with variations of water projection and propulsion systems, particularly of the type which can be utilized with existing personal watercraft devices. Applications for such a generated stream of pressurized water flow resulting from a watercraft exhaust include use by marine fire fighting units, in particular for maritime and waterfront fires, as well as varying types of recreational uses.

U.S. Pat. No. 5,299,960, issued to Day, teaches an auxiliary water projector system for use on a jet propelled watercraft. Upon removal of the water steering nozzle (located at the exhaust of the watercraft) the auxiliary projector system is connected to the existing propulsion system. A thrust control valve is further positioned adjacent the remounted steering nozzle and, using the thrust control valve and a flow control valve, the operation of the watercraft and auxiliary water projector can be simultaneously controlled to include stationary, forward or reverse movement of the watercraft.

U.S. Pat. No. 5,516,313, issued to Lumpkin, discloses a fire fighting accessory for a jet propulsion system and which diverts the water flow generated by the propulsion system for use as the fire fighting implement. The accessory is disclosed as capable of being attached to an existing fluid drive system in a non-interfering relationship with the steering nozzle of the jet. The accessory may also be mounted either downstream or upstream of the jet outlet and is controllable from within the vessel. In further embodiments, the accessory coupler is moved into and out of engagement with the drive unit or to direct water into either the jet outlet or the accessory coupler.

Finally, U.S. Pat. No. 5,846,104, issued to Corcoran, teaches a water diverting apparatus for adaptation into a recreational motor ski vehicle. The diverting apparatus is constructed as a bell housing securable to the jet ski exhaust and including a hole through its top surface near an angled back end. A diverter assembly is provided, having lower, center and upper segments and, upon the diverting apparatus being mounted in place, operates without degrading either the speed or agile maneuvering of the motor ski vehicle.

SUMMARY OF THE PRESENT INVENTION

The present invention discloses a new and improved type of universally applicable valve, hose and nozzle assembly for incorporation into an existing personal watercraft. In particular, the present invention provides the combined advantages of portability and the ability to be easily sized, fitted and reattached to a watercraft vehicle, with a minimum of effort and without any significant disfiguration of the personal watercraft.

Specifically, the watercraft includes an interiorly configured engine compartment operated by a throttle, a rear transom and a rearwardly extending tail pipe. The assembly includes a bilge pump valve adapted to communicate the interiorly configured engine compartment with the rearwardly extending tail pipe. An arcuately shaped water flow diversion member has a first end and a second end, a flexible boot adaptor engaging the first end with the extending end of the tail pipe and the second end extending in communicable and arcuate fashion from the first end and terminating in upwardly projecting fashion above the surface of the water.

A plurality of tensioning members are employed for maintaining the diversion member and flexible boot in seal-tight fashion against the watercraft tail pipe and include individual linkage assembles extending from a flange portion defined on said diversion member. Each of the linkage assemblies engages an eyebolt projecting from a selected location on the transom of the watercraft.

A flexible length of conduit is provided with first and second opposite ends, a first end of which threadably engages the second end of the flow diversion member. The flow distribution member is in turn threadably engageable with the second end of the length of conduit and may further include an outlet nipple. In one variant, the flow distribution member is provided as a pedestal supported unit, to which the first length of conduit is threadably engaged, and a further length of hose, or conduit, is secured to the outlet nipple (such as by threaded engagement). Alternatively, the distribution member may be configured as a threadably attachable and substantially pistol shaped unit and which may further include handle, stock and barrel portions.

In use, the bilge pump valve is actuated from an open position to a closed position and, upon applying the throttle to accelerate the watercraft's engine, the assembly issues a pressurized flow of water through the flow distribution member and its associated outlet nipple. In this manner, water is prevented from back-flowing (in the direction of least pressure) into the engine compartment and sinking the watercraft during use of the assembly.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

Figure 1:
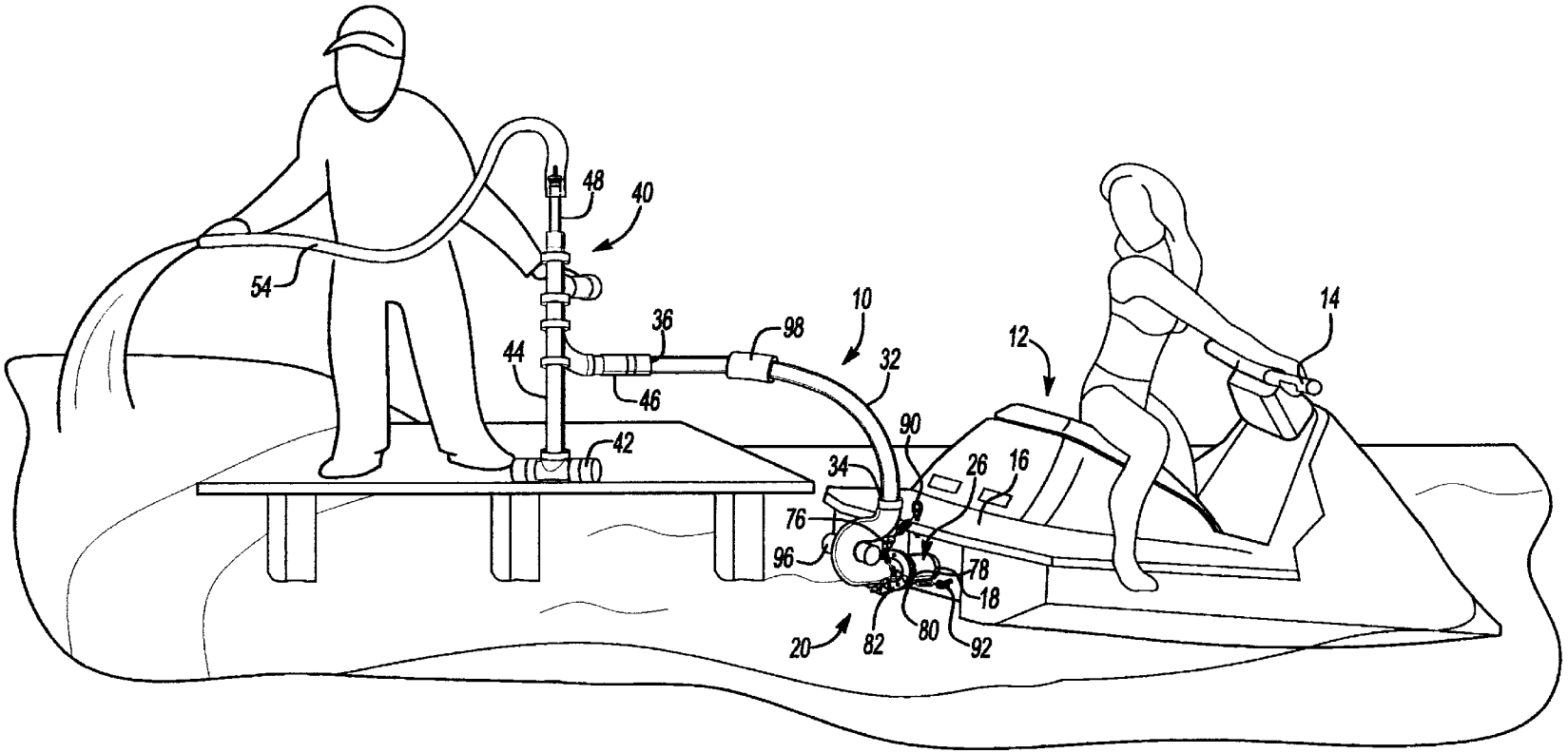
FIG. 1 illustrates an environmental view of the combined valve, hose and nozzle assembly in use with a personal watercraft and according to the present invention.

Referring now to FIG. 1, a universally applicable valve, hose and nozzle assembly is illustrated at 10 for use with a personal watercraft device 12 according to the present invention. As previously described, the present invention discloses a new and improved type of universally applicable valve, hose and nozzle assembly for incorporation into an existing personal watercraft and which, in particular, combines advantages of portability and the ability to be easily sized, fitted and reattached to the watercraft device with a minimum of effort and without any significant disfiguration of the personal watercraft.

Figure 4:
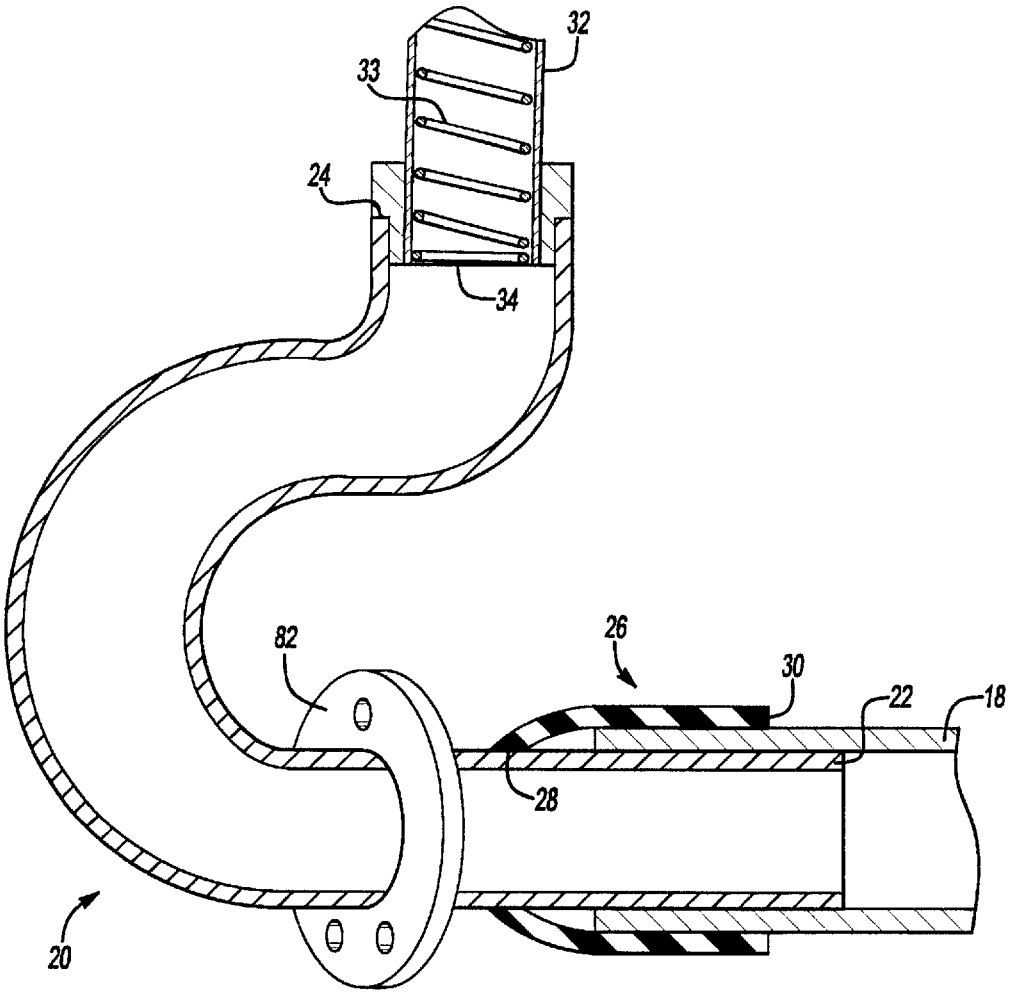
FIG. 4 is a cutaway view taken along line 4—4 of FIG. 3 and illustrating the manner in which the boot secures the arcuate diversion member to the watercraft exhaust at one end, as well as a first extending length of hose secured to and extending from the diversion member at a second end.
Figure 5:
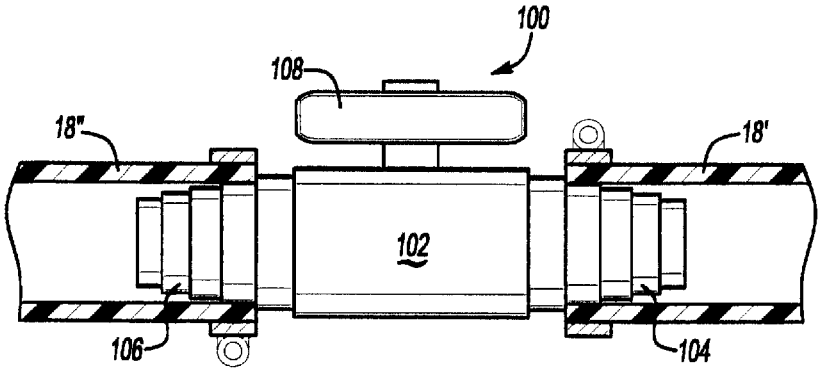
FIG. 5 is a view of a universal bilge pump valve incorporated into the bilge line of the watercraft and actuable between on and off positions to permit operation of said assembly while preventing water from filling the engine compartment.

The personal watercraft device is again shown at 12 and includes such features as an internally configured engine compartment (not shown) operated by a hand throttle 14, a rear transom 16 and a rearwardly extending tail pipe 18 (see also FIGS. 4 and 5). The watercraft represented at 12 also includes such conventional elements as a seat, steering mechanism and the like. It is also envisioned that the assembly 10 of the present invention can be fitted to other types of watercraft, such as larger sized recreational boats and pleasure craft, pontoon boats, and the like without departing from the scope of the present invention.

Figure 2:
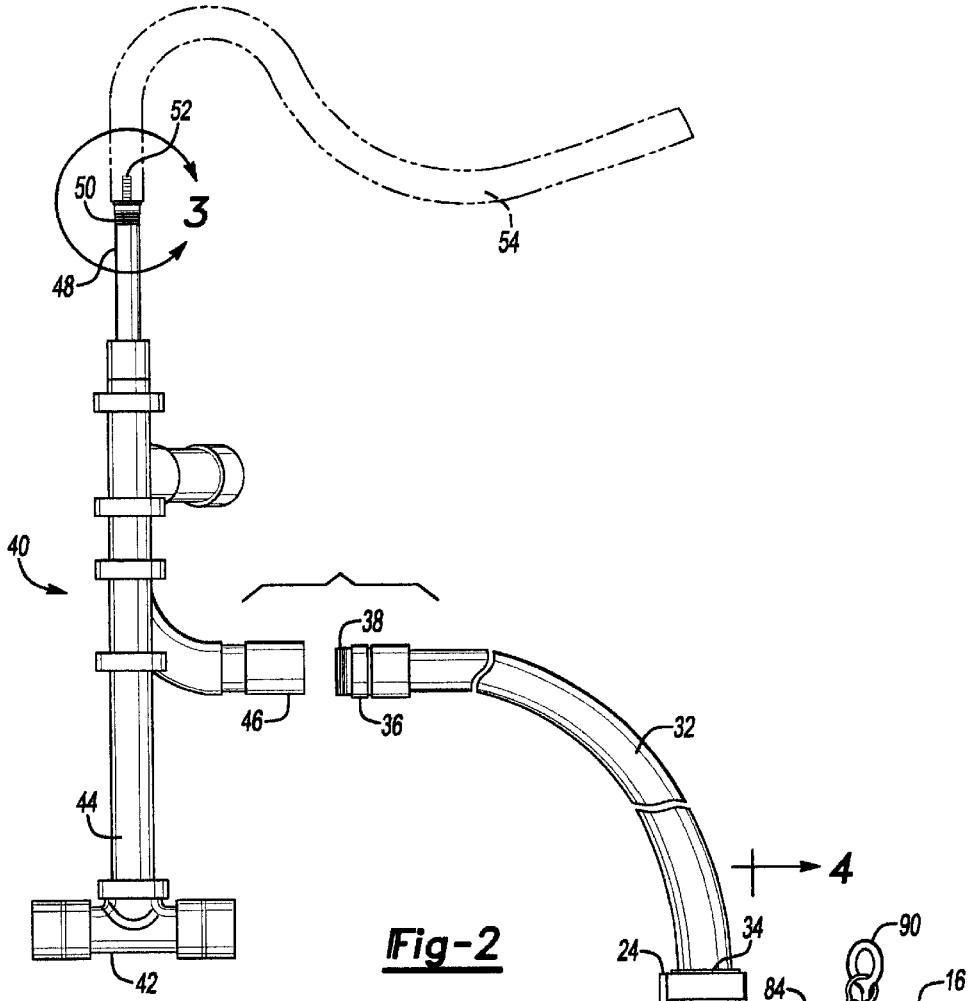
FIG. 2 illustrates a sectional view, in partially exploded fashion, of the present invention and further shows, in enlarged representation, the arrangement of the arcuately configured diversion member, securing boot, interconnecting hose, and supported flow distribution member according to one preferred embodiment of the present invention.

Referring again to FIG. 1, as well as to FIGS. 2 and 4, a water flow diversion member is illustrated generally at 20 and includes a substantially arcuate (modified "S" shaped) configuration with a first end 22 and a second fluidly communicating end 24. The first end 22 is typically sized with an outer diameter of appropriate dimension for inserting within the rearwardly extending end of the existing tail pipe 18. As previously described, an advantage of the system 10 is its ability to fit or retrofit to most types of personal watercraft (or other maritime craft for that matter) and this is further facilitated by the provision of a flexible boot adapter 26.

The adapter 26, as best illustrated in cutaway section in FIG. 4, is constructed of a pliant, internally hollowed and rubberized material with an internally hollowed configuration including a first inwardly curved end 28 and a second annular extending end 30. The boot adapter 26 functions by the inwardly curved end 28 sealingly abutting over an extending portion of the diversion member 20 (from the first end 22), while the annular extending end 30 surrounds and likewise sealingly engages over the tail pipe 18. It is further envisioned that other types of sealing and/or seating members may be provided with the flow diversion member 20 and in order to provide a watertight seal with the exhaust of the watercraft 12.

A flexible and internally hollowed length of conduit 32 is provided having a first end 34 and a second end 36. The first end 34, as best shown in the cutaway of FIG. 4, provides a first engageable end which secures to the associated second end 24 of the arcuately configured and flow diversion member 20. Referring further to the cutaway section of the conduit 32 illustrated in FIG. 4, an internally wound and coiled spring configuration 33 may be employed for providing structural integrity to the conduit and to maintain its fluidly communicating properties. It is however also envisioned that the conduit can be provided in any desirable configuration and dimension without departing from the scope of the invention.

The ends of the conduit, such as again shown at 24, can be configured to engage, such as in a twist and lock fashion, relative to such as the associated end 24 of the flow diversion member 20. Alternatively, and referring further again to FIG. 2, the ends of the flexible and internally hollowed conduit (see again as represented by second end 36) may be provided with externally facing threads 38.

Figure 3:
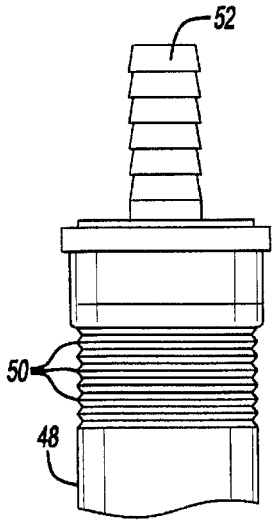
FIG. 3 is an enlarged partial view illustrating a nozzle portion of the flow distribution member according to the preferred embodiment of FIGS. 1 and 2.

A first variation of a flow distribution member is illustrated at 40 in FIGS. 1 and 2 and is provided as a pedestal supporting unit 40 having a base 42, an upwardly extending and internally hollowed body 44 with an inlet 46 communicable with the second end 36 of the conduit 32, and an upwardly directed outlet 48. As further best illustrated in the enlarged sectional view of FIG. 3, the outlet 48 is further defined with additional an exterior facing threads 50 and an outlet nipple 52 extending in terminating fashion.

Figure 6:
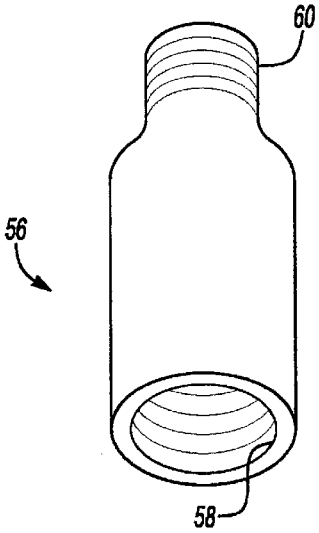
FIG. 6 is a sectional view of a male/female threaded adaptor for use with either or both the flow diversion and flow distribution members.

An additional length of conduit 54, referenced in solid in FIG. 1 and in phantom in FIG. 2, is attached over the outlet nipple 52. In one preferred variant, the additional length of conduit 54 is provided as a conventional garden hose and includes an internally threaded end (not specifically shown) which threadably engages over the external threads 50 associated with the outlet 48 and extending nipple 52 of the flow distribution member 40. Referring further to FIG. 6, an adapter 58 is illustrated which is internally hollowed with a first female threaded end 58 according to a first dimension and a second male threaded end 60 according to a second dimension. The adapter typically is provided in use with the threaded end 50 of the flow distribution member 40 (or even the second end 24 of the flow diversion member 20) and in order to selectively increase or decrease the diameter of the fitting for engaging the second conduit (or hose) 54 or, again in certain instances, the engaging end of the first conduit 32.

Figure 7:
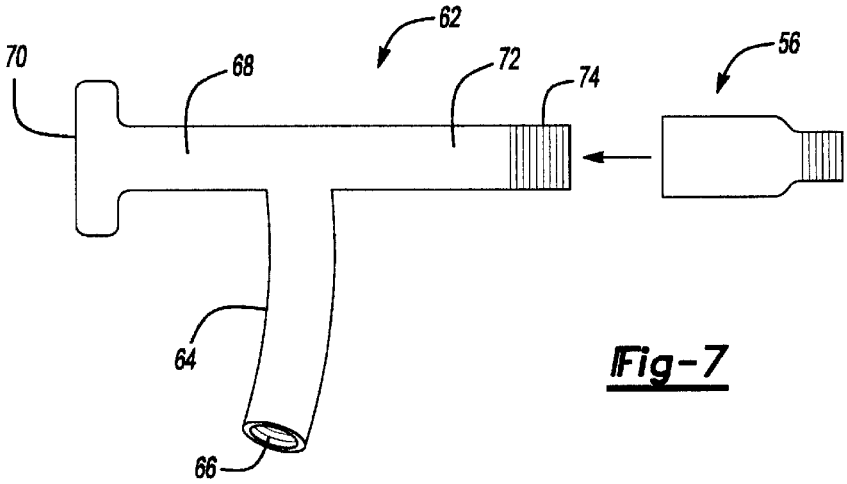
FIG. 7 is a sectional view of a flow distribution member according to a further preferred variant and in the form of a pistol shaped member.

Referring to FIG. 7, an alternate variant 62 of the flow diversion member is illustrated and which includes a substantially pistol shaped member. The pistol shaped member 62 replaces the pedestal supported member 40 of the first preferred variant and includes a handle portion 64 with a first internally threaded and inserting end 66 (such as for engaging the associating second and externally threaded end 38 of the first length of conduit 32). Additional components of the pistol member 62 include a support portion 68, with terminating shoulder stock 70, and a fluidly communicable barrel portion 72 terminating in an externally threaded outlet 74. As illustrated in FIGS. 1 and 2, the second length of conduit 54 (garden hose) may be secured in threadably engageable fashion over the threaded outlet 74 and, as again illustrated in FIG. 7, the adapter 56 can again be employed for changing the outlet 74 dimension of the pistol member 62 for accepting different hose 54 configurations. It is also envisioned that other and additional types of flow distribution members can be employed with the assembly and without departing from the scope of the invention.

Referring again to FIGS. 1 and 2, additional tensioning members 76, 78 and 80 are provided, extending from a flange portion 82 (as best illustrated in partial phantom in FIG. 2 and in FIG. 3) defined in extending fashion from the body of the flow diversion member 20, and for engaging selected locations of the watercraft transom 16 to compressingly engage the first end 22 within the tail pipe 18 and to maintain the boot 26 in coaxially applied fashion. As further best illustrated in FIG. 4, the flange 82 includes three circumferentially spaced apertures for engaging each of the tensioning members 76, 78 and 80. Further, each of the tensioning members 76, 78 and 80 may be provided as a plurality of interconnecting linkage portions.

Referring again to FIG. 2, tension inducing components 84, 86 and 88 (for members 76, 78 and 80, respectively) are provided for each linkage construction and eyebolts 90, 92 and 94 are provided at specified locations on the watercraft transom 16 for engaging the associated tensioning members 76, 78 and 80. In particular, the bolt 90 is provided as a first hull tiedown eyebolt extending in upward fashion in proximity to the rear transom 16 and engages the linkage mechanism 76. The additional pair of eyebolts 92 and 94 extend in rearwardly facing fashion from the transom 16 and are engaged, respectively, by extending ends of the second 78 and third 80 linkage mechanisms. It is also envisioned that other types of tensioning mechanisms, including flexible straps, can be employed or, alternatively, this feature can be deleted within the scope of the invention.

Referring again to FIG. 1, flotation support members 96 and 98 are illustrated in phantom, typically shaped in elongated and slitted cylindrical fashion, and which may be employed with the flow diversion member 20 and length of conduit 32. The advantage of the flotation support members 96 and 98 is that it permits the components of the assembly to remain buoyant upon the surface of the water when detached from the watercraft 12.

Figure 8:
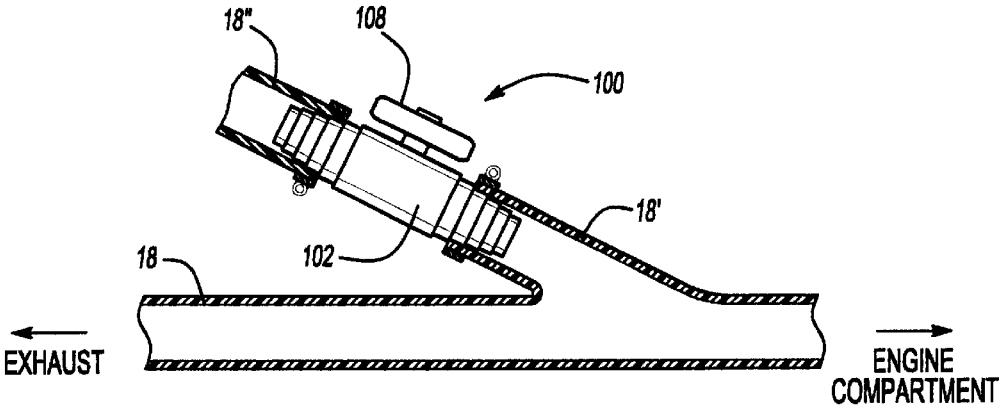
FIG. 8 is an enlarged view in section of the bilge line in association with the main exhaust line of the watercraft.

Referring finally to FIG. 5, as well as to FIG. 8, an illustration is shown of a bilge pump valve, at 100, according to the invention. The valve 100 is located within the body of the watercraft 12 (not evident from FIG. 1) and includes an internally communicable body 102 with a first end 104 engageable with a first section 18' of the bilge pump line and a second end 106 likewise engageable with a second section 18" of the bilge line. The bilge line (18', 18") typically extends in an angular fashion (see again FIG. 8) relative to the main tailpipe exhaust line 18 and, as is known in the art, maintaining a vacuum pressure on the water during normal operation of the watercraft to keep the engine compartment from flooding.

A handle 108 is provided and is accessible from an exterior location of the watercraft 12 in order to be actuated from an open position to a closed position, prior to attachment and operation of the assembly. It has been determined in practice that the valve 100 is a necessary component in that, otherwise, operation of the assembly would result in water flowing in a reverse (vacuum) direction through the bilge line (18', 18") strainer and into the engine compartment (this being determined to be the lowest path of fluid pressure) with the result being the watercraft 12 sinking.

It is therefore evident that the present invention teaches a novel and useful valve, hose and nozzle assembly for use with a personal watercraft. Having described my invention, additional preferred embodiments will become apparent to those skilled in the art to which it pertains and without deviating from the scope of the appended claims.

I claim:

1. A universally adaptable valve, hose and nozzle assembly for use with a personal watercraft, the watercraft including an interiorly configured engine compartment operated by a throttle, a rearwardly extending tail pipe, a rear transom, and an associated bilge line, said assembly comprising:

a bilge pump valve associated with the bilge line and adapted to communicate the interiorly configured engine compartment with the rearwardly extending tail pipe;

a water flow diversion member having a first end adaptable for engaging with the extending end of the tail pipe, a second end of said diversion member extending in communicable and arcuate fashion from said first end;

said water flow diversion member further comprising a plurality of tensioning members adapted to secure to the rear transom, said tensioning members each further comprising individual linkage assemblies;

a flexible length of conduit having first and second opposite ends, a first end of said conduit engaging said second end of said flow diversion member;

a flow distribution member engageable with said second end of said length of conduit; and upon actuating said bilge pump valve from an open position to a closed position and applying the throttle, said assembly issuing a pressurized flow of water through said flow distribution member.

2. The assembly as described in claim 1, the watercraft further including a hull tiedown eyebolt extending in upward fashion in proximity to the rear transom, said assembly further comprising a flange portion extending from said diversion member and interconnecting a first end of each linkage assembly, a pair of eyebolts adapted to being engaged with the rear transom, so that, in combination with said hull tie down eyebolt, second extending ends of each of said linkage assemblies each engage an associated eyebolt.

3. A universally adaptable valve, hose and nozzle assembly for use with a personal watercraft, the watercraft including an interiorly configured engine compartment operated by a throttle, a rearwardly extending tail pipe, and an associated bilge line, said assembly comprising:

a bilge pump valve associated with the bilge line and adapted to communicate the interiorly configured engine compartment with the rearwardly extending tail pipe;

a water flow diversion member having a first end adaptable for engaging with the extending end of the tail pipe, a second end of said diversion member extending in communicable and arcuate fashion from said first end;

a flexible boot adapter for engaging said first end of said flow diversion member to the watercraft tail pipe in a seal tight manner;

a flexible length of conduit having first and second opposite ends, a first end of said conduit engaging said second end of said flow diversion member;

a flow distribution member engageable with said second end of said length of conduit; and upon actuating said bilge pump valve from an open position to a closed position and applying the throttle, said assembly issuing a pressurized flow of water through said flow distribution member.

4. The assembly as described in claim 3, said boot adapter further comprising a substantially cylindrical and interiorly hollowed configuration with a first inwardly curved end and a second annular extending end.

5. A universally adaptable valve, hose and nozzle assembly for use with a personal watercraft, the watercraft including an interiorly configured engine compartment operated by a throttle, a rearwardly extending tail pipe, and an associated bilge line, said assembly comprising:

a bilge pump valve associated with the bilge line and adapted to communicate the interiorly configured engine compartment with the rearwardly extending tail pipe;

a water flow diversion member having a first end adaptable for engaging with the extending end of the tail pipe, a second end of said diversion member extending in communicable and arcuate fashion from said first end;

said flow distribution member further comprising an outlet nipple and a pedestal supporting unit, said assembly further comprising a further length of conduit connected to said outlet nipple;

a flexible length of conduit having first and second opposite ends, a first end of said conduit engaging said second end of said flow diversion member;

a flow distribution member engageable with said second end of said length of conduit; and upon actuating said bilge pump valve from an open position to a closed position and applying the throttle, said assembly issuing a pressurized flow of water through said flow distribution member.

6. The assembly as described in claim 5, said flow distribution member further comprising a substantially pistol shaped member.

7. The assembly as described in claim 6, said pistol shaped member further comprising handle, stock and barrel portions.

8. The assembly as described in claim 5, further comprising a threadably engageable adapter for use with at least one of said outlet nipple of said flow distribution member and said second end of said flow diversion member.

9. A universally adaptable valve, hose and nozzle assembly for use with a personal watercraft, the watercraft including an interiorly configured engine compartment operated by a throttle, a rearwardly extending tail pipe, and an associated bilge line, said assembly comprising:

a bilge pump valve associated with the bilge line and adapted to communicate the interiorly configured engine compartment with the rearwardly extending tail pipe;

a water flow diversion member having a first end adaptable for engaging with the extending end of the tail pipe, a second end of said diversion member extending in communicable and arcuate fashion from said first end;

a flexible length of conduit having first and second opposite ends, a first end of said conduit engaging said second end of said flow diversion member;

at least one flotation support member associated with at least one of said flow diversion member and flexible length of conduit;

a flow distribution member engageable with said second end of said length of conduit; and upon actuating said bilge pump valve from an open position to a closed position and applying the throttle, said assembly issuing a pressurized flow of water through said flow distribution member.

* * * * *